US009038302B1

(12) United States Patent
Pochapsky et al.

(10) Patent No.: US 9,038,302 B1
(45) Date of Patent: May 26, 2015

(54) SHOCK MITIGATION DEVICE AND METHOD THEREFOR, AND SYSTEM EMPLOYING SAME

(75) Inventors: Eugene J. Pochapsky, Cheswick, PA (US); Harry A. Beck, Sarver, PA (US); Christopher D. Yohe, Oakmont, PA (US)

(73) Assignee: OmniTech Partners, Inc., Freeport, PA (US)

( * ) Notice: Subject to any disclaimer, the term of this patent is extended or adjusted under 35 U.S.C. 154(b) by 1825 days.

(21) Appl. No.: 12/220,687

(22) Filed: Jul. 25, 2008

Related U.S. Application Data

(63) Continuation-in-part of application No. 11/879,870, filed on Jul. 19, 2007, now abandoned.

(60) Provisional application No. 60/831,998, filed on Jul. 19, 2006.

(51) Int. Cl.
*F41G 1/387* (2006.01)
*F41G 11/00* (2006.01)

(52) U.S. Cl.
CPC ..... *F41G 11/001* (2013.01)

(58) Field of Classification Search
USPC ..... 42/1.06, 124; 89/37.14, 42.01, 44.01, 89/44.02
See application file for complete search history.

(56) References Cited

U.S. PATENT DOCUMENTS

| | | | | |
|---|---|---|---|---|
| 3,205,580 | A * | 9/1965 | Osborn | 42/124 |
| 3,483,623 | A * | 12/1969 | Kruzell | 42/127 |
| 4,089,536 | A * | 5/1978 | Larrucea | 280/11.28 |
| 4,841,875 | A * | 6/1989 | Corsten et al. | 105/224.05 |
| 5,101,590 | A * | 4/1992 | Hawkins | 42/111 |
| 5,339,789 | A * | 8/1994 | Heitz | 124/56 |
| 5,531,039 | A * | 7/1996 | Gore | 42/124 |
| 5,655,632 | A * | 8/1997 | Valembois | 188/136 |
| 6,678,988 | B1 * | 1/2004 | Poff, Jr. | 42/147 |
| 7,448,306 | B2 * | 11/2008 | Shipman et al. | 89/37.05 |

* cited by examiner

*Primary Examiner* — Reginald Tillman, Jr.
(74) *Attorney, Agent, or Firm* — Wolf, Greenfield & Sacks, P.C.

(57) ABSTRACT

A shock mitigation system for a weapon having a weapon-mounted device that mitigates (reduces and/or reshapes) the total and/or peak acceleration transmitted to the weapon-mounted device when the weapon is fired. The shock mitigation system includes a weapon interface coupled between the weapon and the weapon-mounted device and having a dampening mechanism. In one embodiment, the weapon interface further includes a guide system that allows the weapon-mounted device to move axially relative to the weapon, while substantially limiting non-axial movement, from a first position (static position prior to firing) to a second position (after firing) and return to the first original position. In one embodiment, the dampening mechanism operates to provide bi-directional dampening of both the primary recoil-induced acceleration and any secondary acceleration caused by overshoot. In another embodiment, the dampening mechanism is user-adjustable.

24 Claims, 5 Drawing Sheets

SHOCK MITIGATION DEVICE AND METHOD THEREFOR, AND SYSTEM EMPLOYING SAME

CROSS-REFERENCE TO RELATED APPLICATION

This application is a continuation-in-part of U.S. patent application Ser. No. 11/879,870, filed Jul. 19, 2007, now abandoned which application claims priority under 35 USC 119(e) to U.S. Provisional Patent Application Ser. No. 60/831,998 filed on Jul. 19, 2006. Both prior applications are incorporated herein by reference.

TECHNICAL FIELD

The present invention relates generally to shock mitigation systems for weapons, and more particularly to a shock mitigation device and system for use with a weapon to mitigate shock transmitted or transferred from the weapon to a weapon-mounted device.

BACKGROUND

Upon firing, a weapon incurs a high rate of acceleration in a direction opposite the direction of the projectile. This generates a recoil-induced shock (or acceleration) that is transferred or transmitted to any device that is mounted on the weapon. Some examples of weapon-mounted devices include optical day scopes, night vision devices, illumination systems and laser aiming systems. Generally, manufacturers of weapon-mounted devices design and construct them to handle, or otherwise be immune to, such shock and acceleration. However, weapon-mounted devices are becoming increasingly complex and sensitive. Use of more sensitive components generally results in additional design and engineering efforts/requirements, higher costs or other undesirable attributes such as higher weight or increased system bulk in order to produce a weapon-mounted device capable of meeting a given weapon's shock or acceleration specification.

Thus, it would be beneficial to provide a shock mitigation system that effectively lowers or relaxes the shock/acceleration handling capabilities of the weapon-mounted device while still meeting the weapon's shock/acceleration specifications. This would reduce the costs of manufacturing the weapon-mounted device as well as increase its useful lifetime.

Accordingly, there is needed a shock mitigation system that substantially dissipates or attenuates recoil-induced shock/acceleration (generated upon weapon firing) imparted to a device mounted on the weapon.

SUMMARY

In accordance with one embodiment, there is provided a shock mitigation apparatus for a weapon system including a weapon and a weapon-mounted device. The shock mitigation apparatus includes a weapon interface operable for coupling the weapon to the weapon-mounted device. The weapon interface includes a means or mechanism for allowing limited axial movement of the weapon-mounted device with respect to the weapon and for substantially preventing non-axial movement. The interface further includes a means or mechanism for dampening a recoil-induced shock transmitted from the weapon to the weapon-mounted device, the recoil-induced shock generated and imparted to the weapon when the weapon is fired.

In accordance with another embodiment, there is provided a shock mitigation apparatus for a weapon system including a weapon and a weapon-mounted device. The shock mitigation apparatus includes a weapon interface operable for coupling the weapon to the weapon-mounted device. The weapon interface includes a means or mechanism for allowing limited axial movement of the weapon-mounted device with respect to the weapon and for substantially preventing non-axial movement. The interface further includes a means or mechanism for modifying a recoil-induced shock transmitted from the weapon to the weapon-mounted device, the recoil-induced shock generated and imparted to the weapon when the weapon is fired.

In yet another embodiment, there is provided a shock mitigation apparatus for a weapon system including a weapon and a weapon-mounted device. The shock mitigation apparatus includes a weapon interface operable for coupling the weapon to the weapon-mounted device. The weapon interface includes a means or mechanism for allowing limited multi-axis movement of the weapon-mounted device with respect to the weapon, a means or mechanism for modifying a recoil-induced shock transmitted from the weapon to the weapon-mounted device. The recoil-induced shock is generated and imparted to the weapon when the weapon is fired. The means or mechanism for modifying is further operable for substantially restoring the weapon-mounted device to an original position after firing, with the original position defined as the position of the weapon-mounted device with respect to the weapon prior to firing.

In still another embodiment, there is provided a weapon system including a weapon and a weapon-mounted device. A weapon interface coupled between the weapon and the weapon-mounted device includes a dampening mechanism operable for mitigating a recoil-induced shock generated when the weapon is fired thereby reducing the amount of recoil-induced shock transmitted to the weapon-mounted device.

In another embodiment, there is provided a shock mitigation system for a weapon including an accessory mount, a weapon-mounted device, and a weapon interface coupling the weapon-mounted device to the accessory mount (the weapon being operable to fire a projectile). The shock mitigation system includes at least one guide member structured to couple the weapon-mounted device to the weapon interface, with the weapon-mounted device being movable on at least one guide member with respect to the weapon interface. Also included is at least one resilient member structured to be coupled to the weapon interface and a fastening mechanism structured to couple at least one resilient member to the weapon interface. When the weapon fires the projectile, a recoil-induced shock is imparted on the weapon. At least one resilient member and at least one guide member of the shock mitigation system substantially mitigate the recoil-induced shock by one of: (a) absorbing the recoil-induced shock, (b) dissipating the recoil-induced shock, and/or (c) partially isolating, decoupling, and/or reshaping the recoil-induced shock, in order to minimize the magnitude of the recoil-induced shock transmitted from the weapon to the weapon-mounted device.

Other technical features may be readily apparent to one skilled in the art from the following figures, descriptions, and claims.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION

The present disclosure describes a device or system that mitigates the total and/or peak acceleration (shock) transmitted or transferred to a weapon-mounted device using damping, friction, or compliance or any combination thereof. This allows controlled motion of the weapon-mounted device over a limited range (distance) during which the recoil-induced shock is substantially dissipated, attenuated and/or reshaped before it is transmitted to the mounted device. As will be understood, acceleration or shock is generated primarily in an axial direction (along the longitudinal axis or aiming direction of the weapon) by the firing of the weapon on which the device is mounted.

Figure 1:
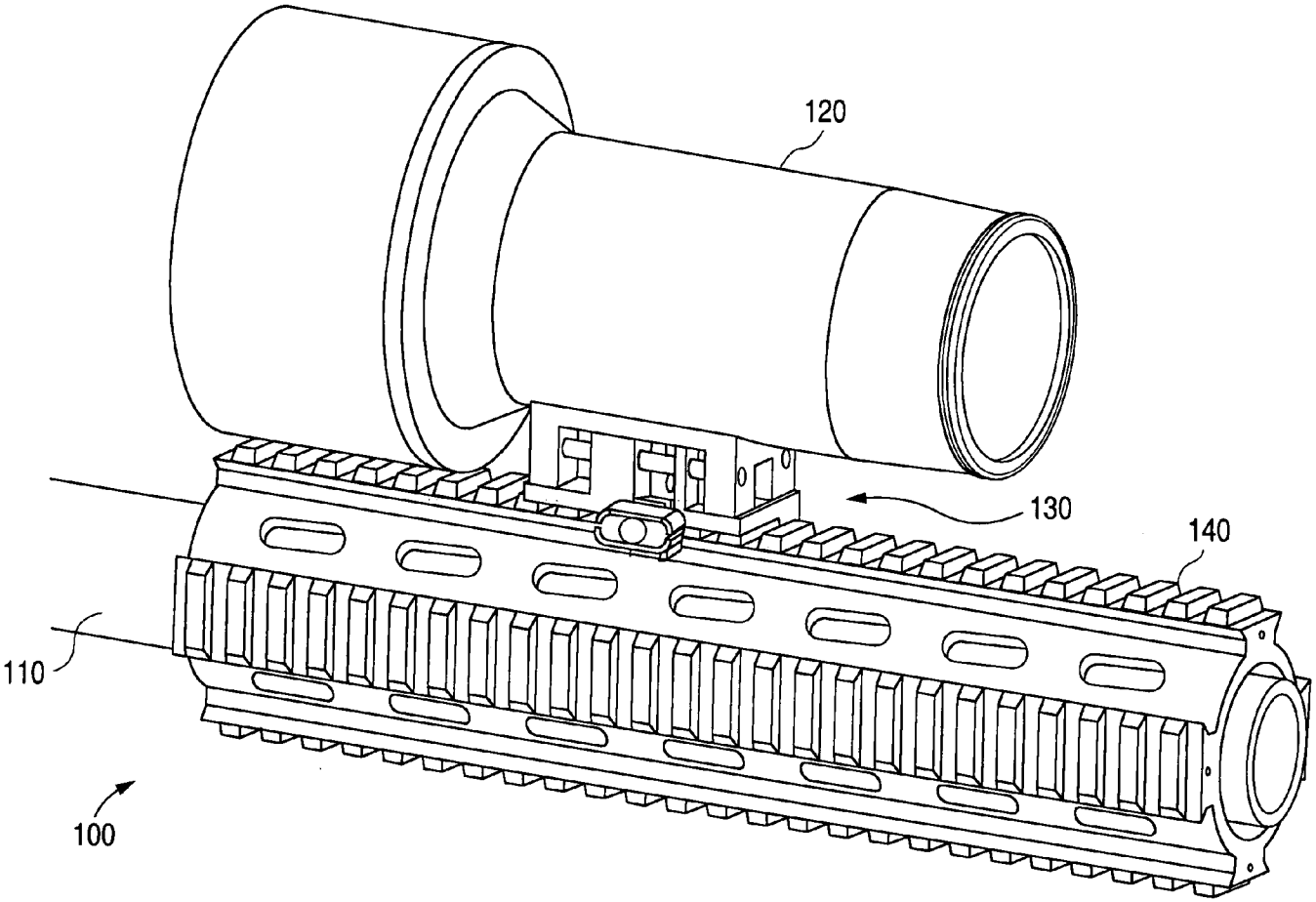
FIG. 1 partially illustrates a weapons system in accordance with the present disclosure.

Now turning to FIG. 1, there is illustrated a partial perspective view of a weapon system 100 in accordance with the present disclosure. The weapon system 100 includes a weapon 110 and a weapon-mounted device 120. As will be appreciated, only a portion of the weapon 110 is shown in FIG. 1, and the weapon 110 typically includes other components, however, illustration of these additional components is unnecessary for an understanding of the present disclosure. Similarly, the weapon system 100 may include other components, such as (an) additional weapon-mounted devices. It will be understood that the weapon 110 may be any type of weapon, such as a handgun, rifle, shotgun, machine gun, grenade launcher, mortar, howitzer, etc. and the like—any weapon that fires or launches a projectile. In one embodiment, the weapon 110 is a hand-held weapon.

The weapon-mounted device 120 includes any device (or accessory) that is intended to be mounted on the weapon 110. Some examples of a weapon-mounted device 120 include day-time optical aiming or sighting systems, night vision systems, tactical flashlights, aiming, targeting or pointing systems (e.g., laser range finders, infrared targeting, etc.), and communication systems. Details of the construction, operation and components of the weapon-mounted device 120 are omitted and are not necessary to enable a person of skill in the art to understand the present disclosure.

The weapon system 100 further includes a shock mitigation device or system 130 that functions as an interface between the weapon 110 and the weapon-mounted device 120. In the embodiment shown, an accessory mounting platform or mount 140 is rigidly coupled to the weapon 110, with the shock mitigation device 130 attached to both the accessory mounting platform 140 and the weapon-mounted device 120. One possible configuration of the accessory mounting platform 140 is illustrated in FIG. 1. This configuration meets the specifications of MIL-STD-1913. Various different configurations of the accessory mounting platform 140 may be utilized, and the accessory mounting platform 140 is in no way limited to the example configuration shown. It will be understood by those skilled in the art that the shock mitigation device or system 130 is coupled to both the weapon 110 and the weapon-mounted device 120. As such, the shock mitigation device 130 may be directly or indirectly connected, mounted or attached to the weapon 110. Similarly, the shock mitigation device 130 may be directly or indirectly connected, mounted or attached to the weapon-mounted device 120. Additionally, the shock mitigation system 130 may also be constructed or exist as a separate sub-system or accessory, and mounted in a permanent or removable manner to the weapon 110 or the weapon-mounted device 120.

Figure 2:
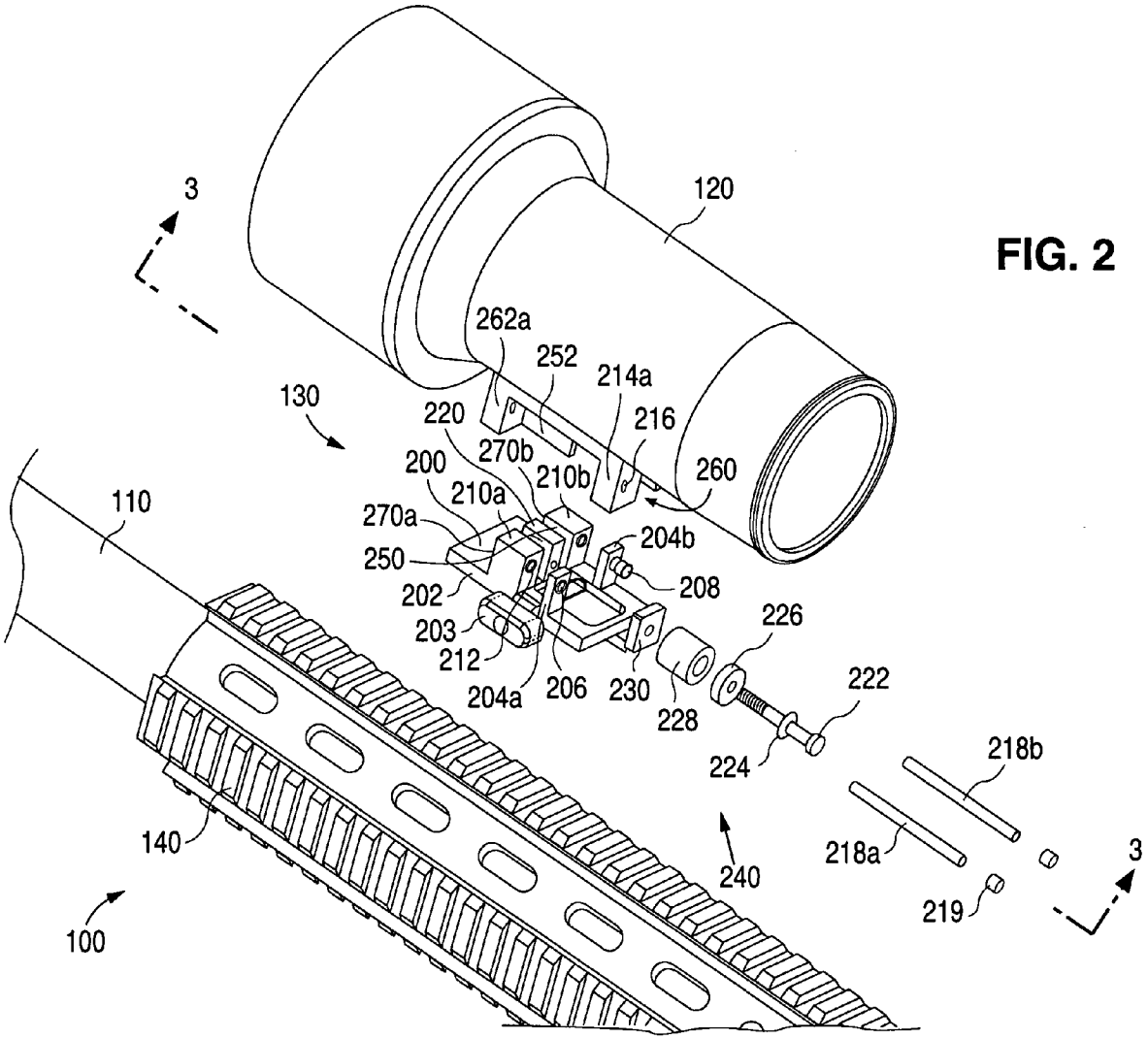
FIG. 2 is an exploded and more detailed view of the weapon system 100 of FIG. 1.

Now turning to FIG. 2, there is shown an exploded and more detailed view of the weapon system 100 of FIG. 1. One embodiment of the shock mitigation device or system 130 is illustrated in FIG. 2.

The shock mitigation device 130 includes a weapon interface 200. The weapon interface 200 couples or mounts the weapon-mounted device 120 to the accessory mounting platform 140. The weapon interface 200 includes a base 202 and an attachment mechanism 203 that secures the base 202 to the accessory mounting platform 140. As will be appreciated, the weapon interface 200 may be directly mounted or connected to the weapon 110 or mounted or connected through another mount or accessory mounting platform 140.

Extending generally vertical from the base 202 are first and second rear mounting members 204*a*, 204*b*, with each having an aperture 206 therethrough. Within each aperture 206 is positioned a guide bushing 208. Also extending generally vertical from the base 202 are first and second forward mounting members 210*a*, 210*b*, with each having a front guide bushing 212 therein (or alternatively an aperture therethrough). Extending generally vertical from the weapon-mounted device 120 is a first rear mounting member 214*a* and a corresponding second rear mounting member 214*b* (not shown), with each having an aperture 216.

First and second guide rods 218*a*, 218*b* extend through the aperture(s) 216 and the aperture(s) 206 (within the guide bushings 208) and further extend into the front guide bushing 212. Two guide rod locks 219 are provided to secure the guide rods 218*a*, 218*b* into the rear mounting members 214*a*, 214*b* of the weapon-mounted device 120. The guide rods 218 are appropriately dimensioned (adequate clearance) with respect to the guide bushings 208 allowing slidable movement of the guide rods 218 within the guide bushings 208—this allows the weapon-mounted device 120 to move axially relative to the weapon interface 200 (and the accessory mounting platform 140, and thus, the weapon 110 itself). The fit between the guide rods 218 and the guide bushings 208 is sufficiently tight to prevent undesired non-axial motion between the weapon-mounted device 120 and the accessory mounting platform 140. Advantageously, this allows axial motion between the weapon interface 200 (and weapon 110) and the weapon-mounted device 120 during the entire weapon firing cycle. Meanwhile, non-axial movement (including radial movement) of the weapon-mounted device 120 is substantially prevented or reduced. In other words, the guide rods 218 configured as shown provide a means for allowing axial movement of the weapon-mounted device 120 with respect to the weapon 110 (and weapon interface 200) while substantially preventing non-axial (including radial movement).

As will be appreciated, the embodiment shown includes two guide rods 218, however, any number of guides may be utilized.

It will be understood that the guide system or means described above may be provided by one or more alternate means or mechanisms. Such means or mechanisms may be a dovetail guide, a recirculating ball guide, an air bearing, any linear guide block and rail system, a square or rectangular guide systems, or individual or multiple flexure springs that function as guides as well as provide a spring or damping mechanism or function, or the like and their equivalents.

Positioned between the first and second forward mounting members 210*a*, 210*b* and extending generally vertical from the base 202 is a dampener mounting member 220 having a threaded aperture for receiving the threaded end of a shock bolt or fastener 222. About (a smooth portion of the) shock bolt 222 are positioned a preload spring 224, a shock washer 226, a dampener element 228 and a shock equalizer 230, as shown. These components are compressed by the shock bolt 222 when the shock bolt 222 is secured to the dampener mounting member 220. The resulting structure provides a rigid mounting during the static state of the weapon system 100.

As will be appreciated, the dampener element 228 or the preload spring 224 (in one embodiment, combined with friction of the required guide mechanism), or the combination thereof, forms a dampening mechanism 240. Though two elements are shown connected in series to form the dampening mechanism 240, a single element and/or any number of elements may be used in any series or parallel arrangement (or combination of series and parallel elements). This dampening mechanism 240 can be configured with selected friction, damping, and spring rates, as determined by the mass of the weapon-mounted device 120 and the total energy of the recoil of the weapon 110. This dampening mechanism 240 effectively reduces the peak transmitted acceleration with a wide range of friction, damping rates, spring rates and/or combinations therein. It will be understood that the dampening mechanism 240 may be constructed using devices that modify the shock imparted to the weapon 110. Such devices may provide little or no "dampening" functions, but will substantially modify the recoil-induced shock by reducing peaks and valleys of acceleration to reduce the shock amplitude and/or lengthen or increase the period of time over which the event(s) occurs. Such devices that modify the shock (without substantial dampening effects) may be springs, or other devices that provide little or no dampening effects. Such shock modifying devices, without having any substantial dampening functionality will likely prolong the life of sensitive components in the weapon-mounted device 120 by themselves. However, as noted, it may be more beneficial, in some embodiments, to include a device or devices (separately or in combination) that provide damping and/or frictional attributes. Both types of elements have practical application depending on the configuration of the weapon-mounted device 120 and other system requirements.

The term "modify" or "modification" (and derivatives) of a recoil-induced shock as used herein refers to any dampening, re-shaping, stretching, reformulation, change and/or de-coupling of energy in a recoil-induced shock transmitted to a weapon-mounted device from a weapon, whether accomplished with springs, friction, dampeners elements, or other structures, devices, means or methods. As such, modifying such shock may be accomplished by frictional effects, spring mechanisms, dampener mechanisms, other devices (and their equivalents) described herein, and any combination of these.

For example, in one embodiment, the dampener element 228 is an elastomeric dampener. These dampeners behave like a conventional compression spring, but because of their shape and material properties, they behave as mechanical dampeners/frictional elements. In one embodiment (as shown), the dampener element surrounds the shock bolt 222. Other embodiments may include the dampener element 240 constrained by some mechanism or component other than a shock bolt 222. Different components may be utilized for the dampener element 228. Alternative arrangements of the dampener element 228 may be also utilized, e.g., series and/or parallel arrangements (or combination thereof). The dampener element 228 may be formed of different elements or structures, including but not limited to elastomeric dampener (s), spring(s), hydraulic dampener(s), pneumatic dampener (s), pneumatic spring(s), gas dampener(s), gas spring(s), leaf spring(s), Belleville or washer-type spring(s), clover spring (s), viscoelastic dampeners with sorbothane or similar or like material, machined (including electrodischarge-machined) or cast flexure spring(s), polymer dampener(s), polymer spring(s), ring spring(s), magnetic or electromagnetic dampener(s), coil spring(s), die spring(s), and/or extension spring (s), and the like.

Referring again to the base 202, positioned between the dampener mounting member 220 and each of the forward mounting members 210*a*, 210*b* is a channel or slot 250. The channels or slots 250 are operable for receiving two corresponding slot members 252 (only one shown in FIG. 2) extending from the weapon-mounted device 120. These structures provide a mechanism of compressing the damping mechanism 240 while allowing axial movement. As will be described in more detail, the slot members 252 each have a rearward-facing edge that contacts the shock equalizer 230.

Referring again to the weapon-mounted device 120, a gap 260 is provided between the first rear mounting member 214*a* and the corresponding second rear mounting member 214*b* (not shown). The gap 260 provides access to the shock bolt 222 for insertion and removal and allows space for the head of the shock bolt 222 when the shock mitigation system 130 is compressed in the primary shock direction (shown in FIG. 4). Also provided are a first forward member 262*a* and a corresponding second forward member 262*b* (not shown) extending generally vertical from the weapon-mounted device 120. In the static position, and in one embodiment, a gap is present between the first and second forward members 262*a*, 262*b* of the weapon-mounted device 120 and forward-facing surfaces 270*a*, 270*b* of the first and second forward mounting members 210*a*, 210*b* of the base 202. As will be appreciated, this gap is necessary for this embodiment as described more fully below, but may not be necessary in other embodiments.

Figure 3:
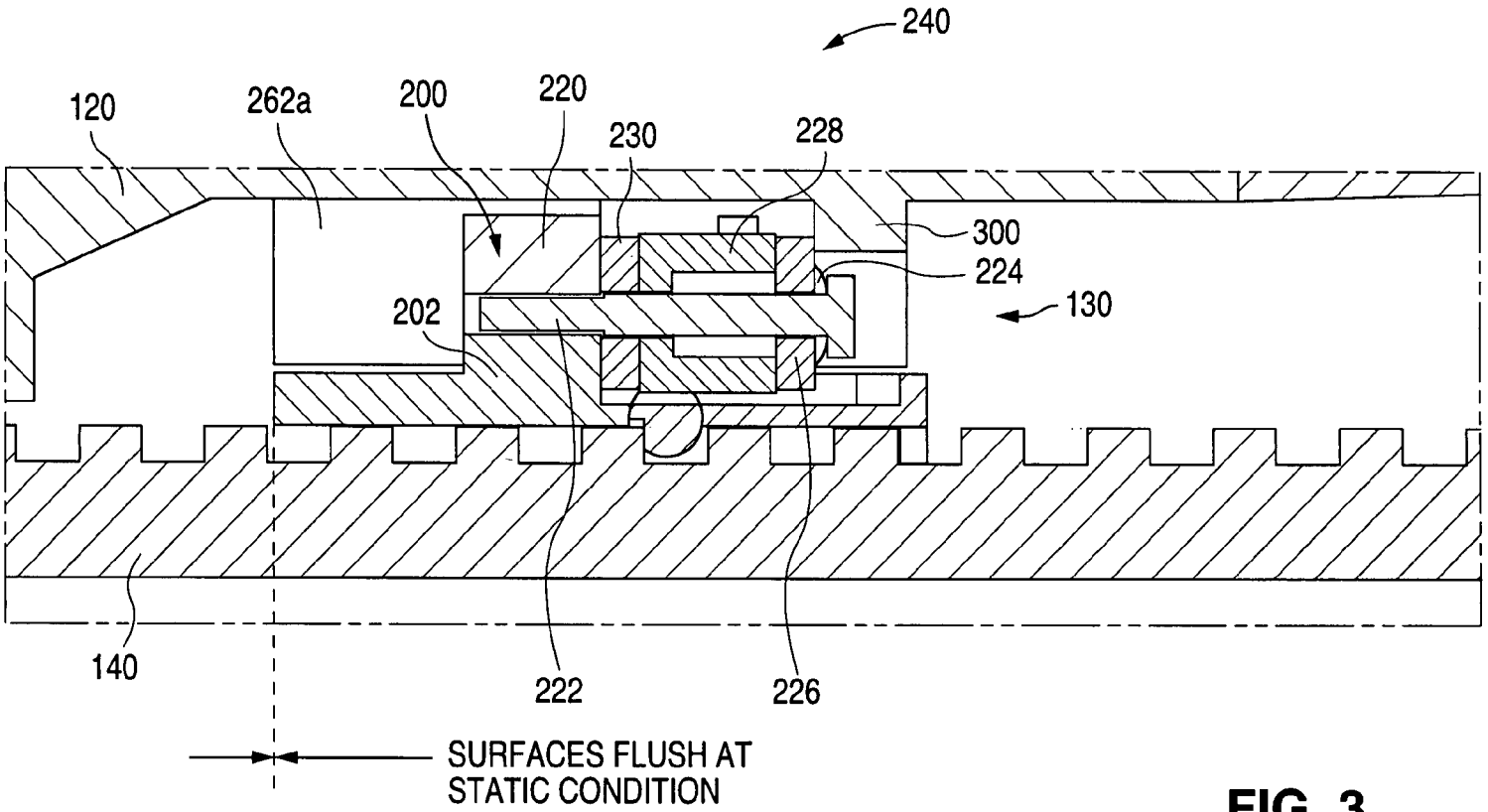
FIG. 3 is a close-up and detailed cross-sectional view (taken along lines 3-3) illustrating the shock mitigation system and interfacing between the weapon-mounted device and the accessory mounting platform of the weapon in a static condition.

Now turning to FIG. 3, there is shown a close-up and detailed cross-sectional view (taken along lines 3-3) of the weapon system 100. This diagram illustrates the shock mitigation system 130 and interfacing between the weapon-mounted device 120 and the accessory mounting platform 140 of the weapon 110 while in a static condition.

FIG. 3 illustrates how the forward facing surfaces of the first and second forward members 262*a*, 262*b* (262*a* not shown) of the weapon-mounted device 120 are flush against a forward-facing surface of the base 202, in the static condition. The condition shown is the static position of the shock mitigation system 130. This condition exists before the weapon 110 is fired and after the shock mitigation system 130 completes its motion. Firing cycle positions are illustrated more fully in FIGS. 4 and 5. In this static condition, there is some compression within the dampening mechanism 240—compression of the dampening element 228 and/or preload spring 224. This static load compression results in an apparently rigid mounting of the weapon-mounted device 120.

Figure 4:
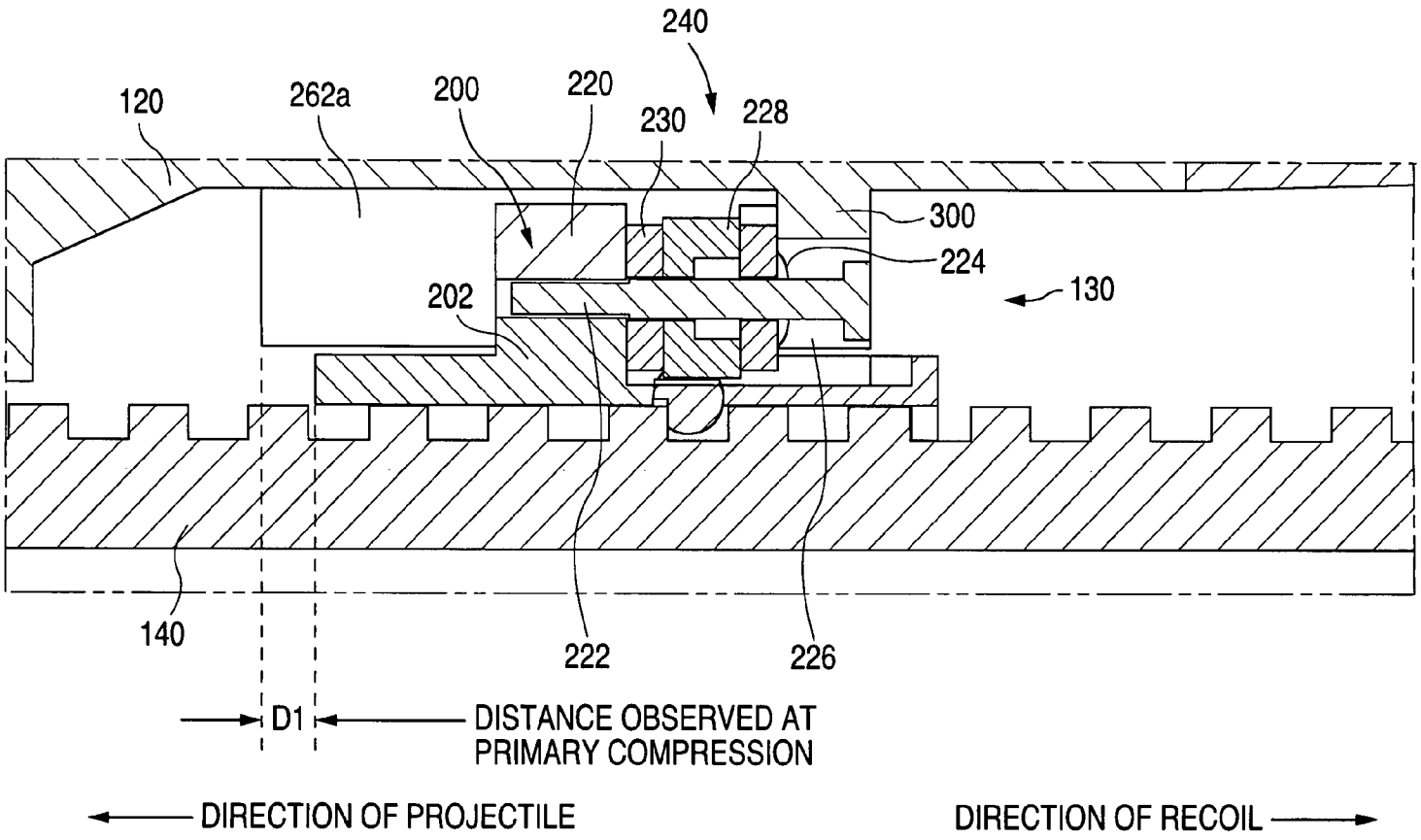
FIG. 4 illustrates the shock mitigation system interfacing between the weapon-mounted device and the accessory mounting platform of the weapon at a time T1 after the weapon is fired.

Now referring to FIG. 4, there is illustrated the shock mitigation system 130 and interfacing between the weapon-mounted device 120 and the accessory mounting platform 140 of the weapon 110 at a time T1 after the weapon is fired. Upon firing of the weapon 110, the weapon interface 200 accelerates in the same direction (to the right in the FIGURE) as the weapon 110. Illustrated is the primary compression of the dampening mechanism 240 (i.e., primary recoil of the weapon).

When the weapon 110 is fired, the weapon 110 and the accessory mounting platform 140 (and attached weapon interface 200) accelerate rapidly as they respond to the forces required to impart energy into the projectile (not shown). The impulse momentum imparted into the weapon-mounted device 120 causes the dampening mechanism 240 (at initial acceleration—compression into the head of the shock bolt 222) to compress into the weapon interface 200. As shown, the shock washer 226 abuts a shoulder of a shock flange 300 extending from the weapon-mounted device 120. As will be appreciated, the shock washer 226 may also abut portions of the rear mounting members 214*a*, 214*b* (though the view of the Figure does not clearly illustrate this). This compresses the dampening mechanism 240 into or against the weapon-mounted device 120. The dampening mechanism 240 reduces the magnitude of the acceleration (in the weapon 110) transmitted to the weapon-mounted device 120 and dissipates a portion of the energy contained in the recoil-induced acceleration pulse. The dampening mechanism 240 further damps the shock mitigation system 130 so as to prevent the weapon-mounted device 120 from oscillating as stored energy is returned from the compressed dampener element 228. Since some energy has been imparted into the weapon-mounted device 120, the weapon-mounted device 120 can recoil and overshoot the static position. This is shown in FIG. 5.

The distance of axial movement of the weapon 110 relative to the weapon-mounted device 120 is denoted in FIG. 4 by the reference "D1". Distance D1 depends on the configuration, structure(s) and material(s) of the dampener mechanism 130 (and other components in the system). In one embodiment, the distance D1 ranges from about 0.01 to about one inch. In another embodiment, the axial movement from the initial firing cycle ranges from about 0.05 to about 0.5. It has been found that a range of between about 0.05 to about 0.20 may be sufficient to reduce or modify the shock transmitted to the weapon-mounted device and provide the benefits described herein.

Figure 5:
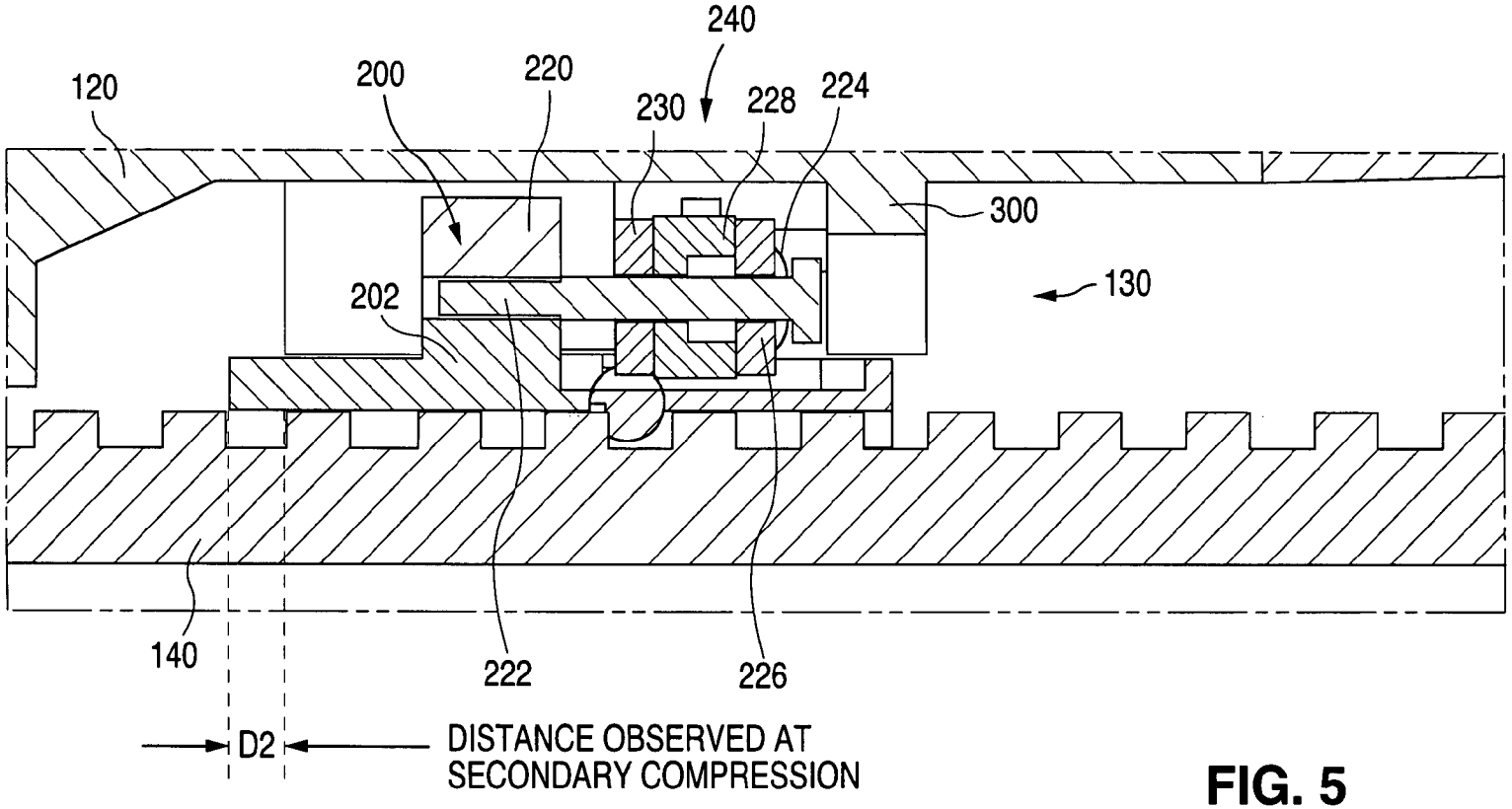
FIG. 5 illustrates the shock mitigation system interfacing between the weapon-mounted device and the accessory mounting platform of the weapon at a time T2 after the weapon is fired.

Now referring to FIG. 5, there is illustrated the shock mitigation system 130 and interfacing between the weapon-mounted device 120 and the accessory mounting platform 140 of the weapon 110 at a time T2 after the weapon is fired. Upon recoil of the weapon-mounted device 120 after it has moved in the forward direction, the weapon-mounted device 120 accelerates in the opposite direction relative to the weapon 110 (to the right in the FIGURE) (i.e., backward). Illustrated is the secondary compression of the dampening mechanism 240 (i.e., secondary recoil of the weapon-mounted device 120).

In this event, the damping mechanism 240 is compressed by the shock equalizer 230 (compressed by slot members 252 of the weapon-mounted device 120) and the head of the shock bolt 222. The shock bolt 222 provides the structure for this compression to occur, allowing bi-directional damping with a single dampener. This mechanism allows the dampening mechanism 240 to be compressed in both directions of travel. The dampening mechanism 240 has a sufficient spring and damping rate to allow the oscillation to come to rest (to the static position—FIG. 3) relatively quickly while reducing the peak acceleration transmitted to the weapon-mounted device 120. In addition, friction between the guide rods 218 and the guide bushings 208 also dissipate some of the energy produced by the weapon 110.

The distance of axial movement of the weapon 110 relative to the weapon-mounted device 120 is denoted in FIG. 5 by the reference "D2". Distance D2 depends on the configuration, structure(s) and material(s) of the dampener mechanism 130 (and other components in the system). In one embodiment, the distance D2 ranges from about 0.001 to about one inch. In another embodiment, the axial movement caused by the secondary compression ranges from about 0.05 to about 0.5. It has been found that a range of between about 0.05 to about 0.20 may be sufficient to reduce or modify this secondary shock transmitted to the weapon-mounted device 120 and provide the benefits described herein.

As will be appreciated different structures and components other than the shock bolt 222 may be used to couple the dampening mechanism 240 between the weapon interface 200 and the weapon-mounted device 120. As one skilled in the art will realize, a shock bolt 222 based system has specific applications. Other embodiments will utilize hydraulic dampener(s), pneumatic dampener(s), pneumatic spring(s), gas dampener(s), gas spring(s), leaf spring(s), Belleville or washer-type spring(s), clover spring(s), viscoelastic dampeners with sorbothane or similar or like material, machined (including electrodischarge-machined) or cast flexure spring (s), polymer dampener(s), polymer spring(s), ring spring(s), magnetic or electromagnetic dampener(s), coil spring(s), die spring(s), and/or extension spring(s), and the like or combinations thereof arranged to dampen, reshape or otherwise modify.

The present disclosure provides a shock mitigation system that reduces, dissipates and/or dampens acceleration (or shock) and/or energy transmitted from a weapon to a weapon-mounted device by allowing controlled motion over a limited range and limited period of time. The motion allowed is in the axial direction while substantially preventing undesired non-axial movement of the weapon-mounted device. As noted above, the guide system (particularly guide rod 218 and the guide bushing 208) or other components (not specifically shown or identified) may inject friction into the system which absorbs some of the energy. Further, other portions of the shock mitigation system 130 may also provide a frictional effect to absorb some energy. One or more additional friction generating components may be added include to further modify the recoil-induced shock as a result of friction introduced for axial movement.

It will be understood that the shock mitigation systems and mounting mechanisms may be constructed or configured using similar frictional, dampening and/or spring components to allow some off-axis rotation and/or motion during weapon shock, which can provide similar mitigation of off-axis acceleration imparted from the weapon to the weapon-mounted device.

In another embodiment, the guide system may provide a different dampening mechanism that dampens in combination with (as primary or secondary), or in lieu of, the dampening mechanism 240. The material of the guide rods 218, the material of the bushings 219 and/or the amount of surface contact area between the guide rods 218 and the guide bushings 208 may be selected to provide a desired dampening friction to dampen the recoil-induced shock. For example, the guide rods may be constructed of metal, such as steel, and the guide bushings 208 constructed of a high friction material, such as high friction ceramic, where the two materials provide additional friction as the guide rods move relative to the bushings. In addition, springs or other mechanisms may be included in the guide system between the base 202 and a mounting member of the weapon-mounted device 120 (e.g., springs positioned around the guide rods) to provide further dampening.

Though not shown, a friction brake structure independent of the guide system may be included to provide braking friction, such as a constant force friction brake. The brake structure may be positioned at any moving interface or in any location not currently occupied by components, such as the areas fore and aft of the guide, or mounted to the exterior of the structure. Further, the friction brake may be self-adjusting, such that its force increases as the acceleration of the system is increased.

In another approach (not shown), the dampening mechanism 240 may be a structure in the form of an energy storage device, such as a flywheel coupled to a sub-system such as a gear reducer, that dissipates energy through the sub-system's inefficiency or the storing of energy that may be used to perform useful work. Such a mechanism may operate to change the induced motion either directionally or from linear to rotational. An energy conversion system, such as a gear reducer or an electrical generator, stores energy from the recoil-induced shock for later use and/or dissipates the energy deliberately and/or as a result of conversion inefficiencies.

In yet another approach (not shown), the dampening mechanism 240 may be adjustable to minimize the shock transmitted to the weapon-mounted device 120 over a wide range of weapon platforms. This adjustability (i.e., dynamic) may be provided through a user-adjustable mechanism or a self-adjusted mechanism occurring base on the magnitude of the applied acceleration. This allows for the maximum reduction in the transmitted acceleration depending on the type of weapon. For example, the dampening mechanism may be adjusted to handle the energy from a smaller weapon, such as a .223 caliber rifle, or adjusted for a higher energy weapon, such as a .50 caliber rifle. This may be accomplished with a compression adjustment on a spring, a variable-rate spring having a spring rate that increases with an increase in the displacement of the weapon-mounted device 120 with respect to the mount 140, or a frictional device whose contact area changes as a function of the displacement between the weapon-mounted device 120 and the mount 140, or a velocity-dependent damper having a damping rate that is varied by a change in the total in the fluid transfer area as a function of the displacement between the weapon-mounted device 120 and the rail 140.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A shock mitigation apparatus for a weapon system including a weapon and a weapon-mounted device, the shock mitigation apparatus comprising:

a weapon interface operable for coupling the weapon to the weapon-mounted device, the weapon interface comprising, means for allowing limited axial movement of the weapon-mounted device with respect to the weapon and for substantially preventing non-axial movement, and means for dampening a recoil-induced shock transmitted from the weapon to the weapon-mounted device, the recoil-induced shock generated and imparted to the weapon when the weapon is fired.

2. The shock mitigation apparatus in accordance with claim 1 wherein the means for allowing limited axial movement comprises at least one guide member and the weapon-mounted device being movable on the at least one guide member.

3. The shock mitigation apparatus in accordance with claim 1 wherein the means for dampening the recoil-induced shock comprises a dampening mechanism.

4. The shock mitigation apparatus in accordance with claim 3 wherein the dampening mechanism comprises an elastomer dampener.

5. The shock mitigation apparatus in accordance with claim 4 wherein the dampening mechanism further comprises a spring coupled in series with the elastomer dampener.

6. The shock mitigation apparatus in accordance with claim 1 wherein the means for dampening provides bi-directional damping in an axial direction.

7. A shock mitigation apparatus for a weapon system including a weapon and a weapon-mounted device, the shock mitigation apparatus comprising:

a weapon interface operable for coupling the weapon to the weapon-mounted device, the weapon interface comprising, means for allowing limited axial movement of the weapon-mounted device with respect to the weapon and for substantially preventing non-axial movement, and means for modifying a recoil-induced shock transmitted from the weapon to the weapon-mounted device, the recoil-induced shock generated and imparted to the weapon when the weapon is fired.

8. The shock mitigation apparatus in accordance with claim 7 wherein the means for modifying comprises a dampener mechanism.

9. The shock mitigation apparatus in accordance with claim 7 wherein the means for modifying the recoil-induced shock comprises a spring mechanism.

10. The shock mitigation apparatus in accordance with claim 9 wherein the spring mechanism comprises a plurality of springs configured in a series, parallel or series/parallel arrangement.

11. The shock mitigation apparatus in accordance with claim 7 wherein the means for modifying comprises a dampener mechanism and a spring mechanism in a series, parallel or series/parallel arrangement.

12. A shock mitigation apparatus for a weapon system including a weapon and a weapon-mounted device, the shock mitigation apparatus comprising:

a weapon interface operable for coupling the weapon to the weapon-mounted device, the weapon interface comprising, means for allowing limited axial movement of the weapon-mounted device with respect to the weapon, means for modifying a recoil-induced shock transmitted from the weapon to the weapon-mounted device, the recoil-induced shock generated and imparted to the weapon when the weapon is fired, and wherein the means for modifying is further operable for substantially restoring the weapon-mounted device to an original position after firing, the original position defined as the position of the weapon-mounted device with respect to the weapon prior to firing.

13. The shock mitigation apparatus in accordance with claim 12 wherein the means for allowing limited axial movement comprises at least one guide member and the weapon-mounted device being movable in an axial direction on the at least one guide member.

14. The shock mitigation apparatus in accordance with claim 12 wherein the means for modifying the recoil-induced shock comprises a dampener.

15. The shock mitigation apparatus in accordance with claim 14 wherein the dampener comprises an elastomer dampener.

16. The shock mitigation apparatus in accordance with claim 14 wherein the means for modifying further comprises a spring coupled to the dampener.

17. The shock mitigation apparatus in accordance with claim 12 wherein the means for modifying provides bi-directional mitigation in an axial direction.

18. The shock mitigation apparatus in accordance with claim 12 wherein the means for modifying the recoil-induced shock comprises a spring mechanism.

19. The shock mitigation apparatus in accordance with claim 12 wherein the means for modifying the recoil-induced shock comprises a plurality of springs configured in a series, parallel or series/parallel arrangement.

20. The shock mitigation apparatus in accordance with claim 12 wherein the means for modifying the recoil-induced shock comprises a dampener mechanism and a spring mechanism in a series, parallel or series/parallel arrangement and/or combinations therein.

21. A weapon system comprising:

a weapon having an accessory mounting platform rigidly coupled thereto;

a weapon-mounted device; and a weapon interface rigidly coupled between the accessory mounting platform and the weapon-mounted device, the weapon interface comprising a dampening mechanism operable for mitigating a recoil-induced shock generated when the weapon is fired thereby reducing or reshaping the recoil-induced shock transmitted to the weapon-mounted device.

22. The weapon system in accordance with claim 21 wherein the weapon-mounted device contains an image intensifier and the dampening mechanism comprises at least one of: a means for dampening and a spring mechanism.

23. The weapon system in accordance with claim 22 wherein the means for dampening provides bi-directional damping in an axial direction.

24. The weapon system in accordance with claim 21 wherein the dampening mechanism is user-adjustable.

* * * * *